US009072151B2

(12) United States Patent
Xie et al.

(10) Patent No.: US 9,072,151 B2
(45) Date of Patent: Jun. 30, 2015

(54) HIGH INTENSITY DISCHARGE ELECTRONIC BALLAST CIRCUIT, ELECTRONIC BALLAST, AND HIGH INTENSITY DISCHARGE LAMP

(75) Inventors: Lishan Xie, Shenzhen (CN); Yujia Chen, Shenzhen (CN); Qinghui Yuan, Shenzhen (CN); Hongmin Yang, Shenzhen (CN)

(73) Assignee: GUANGDONG GREENLIGHT PHOTOELECTRIC TECHNOLOGY CO., LTD, Dongguan, Guangdong (CN)

( * ) Notice: Subject to any disclaimer, the term of this patent is extended or adjusted under 35 U.S.C. 154(b) by 107 days.

(21) Appl. No.: 14/004,647

(22) PCT Filed: Jul. 26, 2011

(86) PCT No.: PCT/CN2011/077644

§ 371 (c)(1),
(2), (4) Date: Sep. 11, 2013

(87) PCT Pub. No.: WO2012/145972

PCT Pub. Date: Nov. 1, 2012

(65) Prior Publication Data

US 2014/0001957 A1 Jan. 2, 2014

(30) Foreign Application Priority Data

Apr. 28, 2011 (CN) ..... 2011 1 0108978

(51) Int. Cl.

| | |
|---|---|
| ***H05B 41/00*** | (2006.01) |
| ***H05B 37/02*** | (2006.01) |
| ***H05B 39/02*** | (2006.01) |
| ***H05B 39/04*** | (2006.01) |
| ***H05B 41/16*** | (2006.01) |
| ***H05B 41/288*** | (2006.01) |

(52) U.S. Cl.
CPC ..... *H05B 41/16* (2013.01); *H05B 41/2882* (2013.01)

(58) Field of Classification Search
None
See application file for complete search history.

(56) References Cited

U.S. PATENT DOCUMENTS

| | | | | |
|---|---|---|---|---|
| 5,049,790 | A * | 9/1991 | Herfurth et al. | 315/291 |
| 6,181,080 | B1 * | 1/2001 | Schleicher | 315/248 |
| 6,744,220 | B2 * | 6/2004 | Neidlinger | 315/244 |

* cited by examiner

*Primary Examiner* — Douglas W Owens
*Assistant Examiner* — Dedei K Hammond
(74) *Attorney, Agent, or Firm* — Shimokaji & Associates, P.C.

(57) ABSTRACT

A high intensity discharge (HID) ballast circuit comprises a trigger circuit, a power half-bridge self-excited oscillation circuit, which is arranged to enable self-excited oscillation by energizing an angle capacitor $C_{gs}$ with a Miller capacitor $C_{dg}$ of a power MOSFET when an original single pulse output by the trigger circuit is excited, and then output self-excited oscillation signals; and a filter loop which is arranged to match impedance for the self-excited oscillation signals, thereby converting a low-impedance voltage source to a high-impedance constant current source. The inherent phase relationship of the power MOSFET is utilized, and oscillation signals are generated by a power half-bridge self-excited oscillation circuit, and then impedance matching for the oscillation signals is performed by the filter loop, and finally an HID lamp is triggered. As a result, damages to human eyes caused by stroboscopic effect can be avoided and electro magnetic compatibility test can be passed.

18 Claims, 3 Drawing Sheets

HIGH INTENSITY DISCHARGE ELECTRONIC BALLAST CIRCUIT, ELECTRONIC BALLAST, AND HIGH INTENSITY DISCHARGE LAMP

FIELD OF THE INVENTION

The present invention relates to an electronic technical field, and more particularly to a high intensity discharge electronic ballast circuit, an electronic ballast, and a high intensity discharge lamp.

BACKGROUND OF THE INVENTION

As an increasing demand of the energy saving lighting in the current society, high intensity discharge (HID) lamps have replaced halogen lampa and high-tension mercury lamps and become a new efficient light source in the world due to their advantages such as energy saving and high light, etc. While a ballast in the HID lamp is the most important part that determines the quality of the HID lamp.

Generally, the HID ballasts include HID electronic ballasts and HID inductive ballasts. And the HID ballasts has replaced the HID inductive ballasts due to their outstanding advantages, such as a constant power, less power pollution, high utilization of power, and efficient photoelectric conversion.

FIG. 1 illustrates a schematic of a conventional three-stage conversion HID electronic ballast, which includes a rectifier filter circuit 1, a boost circuit 12, a buck circuit 13, and a full-bridge drive circuit 14.

An input terminal of the rectifier filter circuit 11 is connected with the VC supply voltage, and an output terminal of the rectifier filter circuit 11 is connected with an input terminal of the boost circuit 12. The boost circuit 12 has a control terminal connected with an IC 15, and the output terminal of the boost circuit 12 is connected with an input terminal of the buck circuit 13. A control terminal of the buck circuit 13 is connected with an output control terminal P1 of a MUC (Micro Control Unit) and auxiliary circuit 16, and an output terminal of the buck circuit 13 is connected with an input terminal of the full-bridge drive circuit 14. The full-bridge drive circuit 14 has a first control terminal connected with an output control terminal P2 of a MUC and auxiliary circuit 16, a second control terminal connected with an output control terminal P3 of a MUC and auxiliary circuit 16, a third control terminal connected with an output control terminal P4 of a MUC and auxiliary circuit 16, a fourth control terminal connected with an output control terminal P5 of a MUC and auxiliary circuit 16, and an output terminal connected with a load—a HID lamp.

The rectifier filter circuit 11 includes a rectifier bridge 111 and a capacitor C1. An input terminal of the rectifier bridge 111 is the input terminal of the rectifier filter circuit 11; an output terminal of the rectifier bridge 111 is grounded via the capacitor C1. And the output terminals of the rectifier bridge 111 and the capacitor C1 constitutes the output terminal of the rectifier filter circuit 11.

The boost circuit 12 includes an inductor L1, a diode D1 and a switching transistor Q1. One terminal of the inductor L1 is the input terminal of the boost circuit 12, the other terminal of the inductor L1 is coupled with an anode of the diode D1, and a cathode of the diode D1 is the output terminal of the boost circuit 12. The switching transistor Q1 has a drain electrode coupled with the anode of the diode D1, a source electrode grounded, and a gate electrode being the control terminal of the boost circuit 12.

The buck circuit 13 includes a capacitor C2, a switching transistor Q2, and a diode D2. An anode of the capacitor C2 is the input terminal of the buck circuit 13, and a cathode of the capacitor C3 is grounded. The switching transistor Q2 has a drain electrode coupled with the anode of the capacitor C2, and a source electrode coupled with a cathode of the diode D2. An anode of the diode D2 is grounded. A connection terminal of the switching transistor Q2 and the diode D2 is the output terminal of the buck circuit 13, and a control terminal of the switching transistor Q2 is the control terminal of the buck circuit 13.

The full-bridge drive circuit 14 includes inductors L2, L3, capacitors C3, C4, and switching transistors Q3, Q4, Q5, Q6. One terminal of the inductor L2 is the input terminal of the full-bridge drive circuit 14, and the other terminal of the inductor L2 is grounded via the capacitor C3. A connection terminal of the inductor L2 and the capacitor C3 is coupled with a drain electrode of the switching transistor Q3, a gate electrode of the switching transistor Q3 is the first control terminal of the full-bridge drive circuit 14, and a source electrode of the switching transistor Q3 is connected with a drain electrode of the switching transistor Q4. The switching transistor Q4 further has a gate electrode that it is the second control terminal of the full-bridge circuit drive circuit 14, and a source electrode grounded. Concretely, the switching transistor Q5 has a drain electrode connected with the drain electrode of the switching transistor Q3, a gate electrode that is the third control terminal of the full-bridge drive circuit 14, and a source electrode connected with a drain electrode of the switching transistor Q6. A gate electrode of the switching transistor Q6 is the fourth control terminal of the full-bridge drive circuit 14, and a source electrode of the switching transistor Q6 is grounded. A connection terminal of the switching transistors Q3, Q4 is connected with one terminal of the inductor L3, and the other terminal of the inductor L3 is the output terminal of the full-bridge drive circuit 14. And a connection terminal of the switching transistors Q5, Q6 is grounded via the capacitor C4.

The electronic ballast applies low-frequency pulse excitation to light the lamp, and the electronic ballast circuit includes three-stage conversion as following.

Boost conversion. Concretely, the AC is rectified by the rectifier bridge 111 and filtered by the capacitor C1, and then carried out active power factor compensation (APFC) by the IC 15 to eliminate the reactive power. Meanwhile, voltage is increased as the power supply is connected in series with the energy-storage inductor L1, and then rectified and filtered by diode D1 and the capacitor C2, finally is converted into a stable DC voltage of 400V. Thereby, the boost circuit 12 accomplishes the boost conversion.

Buck conversion. As a sequel, the DC voltage of 400V is then discharged via the capacitor C2 and decreased to about 80-120V suited for a full-bridge operating voltage by the switching transistor Q2 controlled by the MUC and auxiliary circuit 16, thereby achieving a constant power operation, meanwhile, the diode D2 is used for clamping. Thereby, the buck circuit 13 accomplishes the buck conversion.

dc-ac conversion. under the control of the muc and auxiliary circuit 16, the full-bridge drive circuit 14 consisted by the inductor 12, capacitor c3, switching transistors q3, q4, q5 and q6, inductor 13, and capacitor c4 coverts the full-bridge operating voltage 80-120 v (dc) into low-frequency square wave pulses with an operating frequency that is lower than 400 hz, and generally between 120-180 hz.

Experimental statistic shows that, "acoustic resonance" may often happen under the operating frequency between 10 KHz to 150 KHz, and rarely happen under the operation frequency higher than 250 KHz. The three-stage conversion HID electronic ballast can efficiently solve the acoustic resonance and constant power problems, but its efficiency will be decreased after any conversion since three conventions are performed. Furthermore, as the magnitude of its operating frequency and the power frequency is the same, thus stroboscopic effect still exists. And a lot of higher harmonics may be generated during the square wave pulses supplying power, which causes electro magnetic compatibility (EMC) test failed.

SUMMARY OF THE INVENTION

Accordingly, an objective of the present invention is to provide an HID electronic ballast circuit, to improve luminous efficiency, and prevent stroboscopic effect generated in the electronic ballast circuit and solve problem of failed EMC test.

To achieve the objective, an HID electronic ballast circuit includes:

a trigger circuit, a power half-bridge self-excited oscillation circuit, having an input terminal coupled with an output terminal of the trigger circuit, arranged to enable self-excited oscillation by energizing an angle capacitor $C_{gs}$ with a miller capacitor $C_{dg}$ of a power MOSFET when an original single pulse output by the trigger circuit is excited, and then output self-excited oscillation signals, and a filter loop, having an input terminal coupled with an output terminal of the power half-bridge self-excited oscillation circuit and an output terminal connected with a load HID lamp tube, arranged to match impedance for the self-excited oscillation signals, thereby converting a low-impedance voltage source to a high-impedance constant current source.

Another objective of the present invention is to provide an electrical ballast with an HID electronic ballast circuit mentioned above.

Yet one objective of the present invention is to provide an HID lamp with an electrical ballast mentioned above.

In the embodiments of the present invention, oscillation signals with a frequency range beyond "acoustics resonance" are generated by utilizing self-feedback of the inherent phase relationship of the power MOSFET, which efficiently prevents the stroboscopic effect and improves the luminous efficiency, and keeps the power MOSFET in a low-temperature and stable status and with high power. Furthermore, impedance matching for the oscillation signals is performed by the filter loop, thereby extending the frequency bandwidth and reducing the Q-value, and keeping the constant power supply at the same time, which makes the EMC test pass easily and improves the stability and reliability of the power output circuit. Additionally, the filter loop can replace a drive circuit to trigger the HID lamp, which simplifies the circuit and reduces the manufacturing cost.

DETAILED DESCRIPTION OF ILLUSTRATED EMBODIMENTS

Other aspects, features, and advantages of this invention will become apparent from the following detailed description when taken in conjunction with the accompanying drawings, which are a part of this disclosure and which illustrate, by way of example, principles of this invention.

With the embodiments of the present invention, the inherent phase relationship of the power MOSFET (Metallic Oxide Semiconductor Field Effect Transistor) is utilized, and oscillation signals are generated by a power half-bridge self-excited oscillation circuit, and then impedance matching for the oscillation signals is performed by a filter loop, and finally an HID lamp is triggered. As a result, damages to human eyes caused by stroboscopic effect can be avoided and electro magnetic compatibility (EMC) test can be passed.

Figure 1:
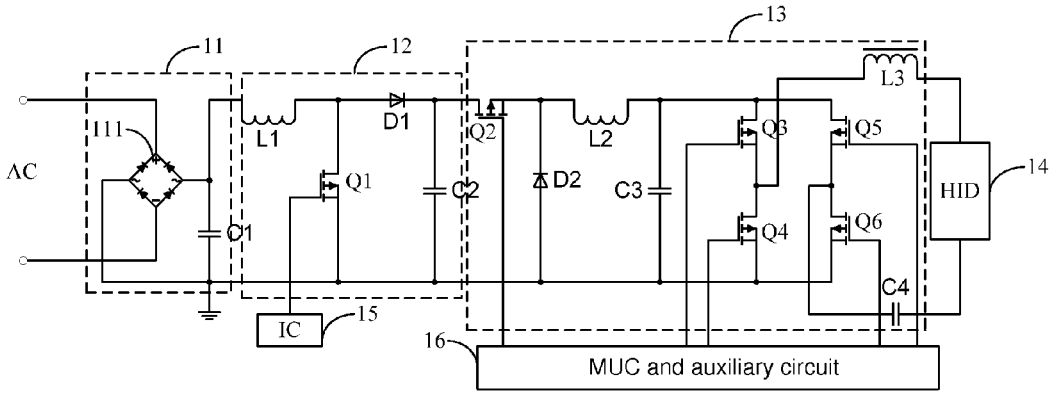
Fig. 1(Prior art)
FIG. 1 is a schematic diagram of a conventional three-stage conversion HID electronic ballast.
Figure 2:
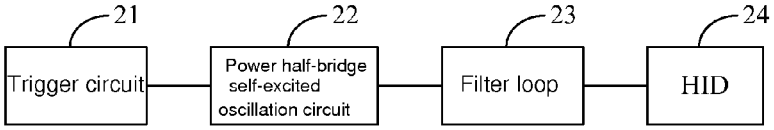
FIG. 2 is a structural diagram of an HID electronic ballast circuit according to an embodiment of the present invention.

FIG. 2 is a structural diagram of an HID electronic ballast circuit according to an embodiment of the present invention. For convenience to explain, only relevant parts are illustrated.

The HID electronic ballast circuit of the present invention can be applicable to various HID electronic ballasts and HID lamps.

The HID electronic ballast circuit according to an embodiment of the present invention includes a trigger circuit 21; a power half-bridge self-excited oscillation circuit 22, having an input terminal coupled with an output terminal of the trigger circuit 21, arranged to enable self-excited oscillation by energizing an angle capacitor $C_{gs}$ with a miller capacitor $C_{dg}$ of an internal power MOSFET when an original single pulse output by the trigger circuit is excited, and then output self-excited oscillation signals; and a filter loop 23, having an input terminal coupled with an output terminal of the power half-bridge self-excited oscillation circuit 22 and an output terminal connected with a load—a HID lamp tube 24, arranged to match impedance for the self-excited oscillation signals, thereby converting a low-impedance voltage source to a high-impedance constant current source.

Accomplishment of the invention will be described by combination with the specific embodiments.

Figure 3:
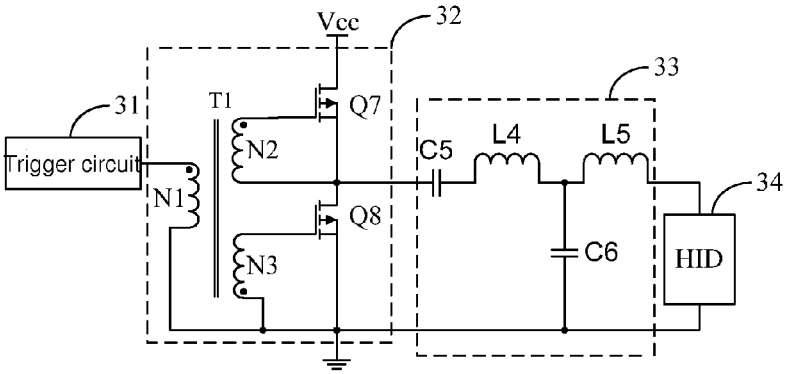
FIG. 3 is a schematic diagram of an HID electronic ballast circuit according to an embodiment of the present invention.

FIG. 3 is a schematic diagram of the HID electronic ballast circuit according to an embodiment of the present invention. For convenience to explain, only relevant parts are illustrated.

The HID electronic ballast circuit of the present embodiment includes a trigger circuit 31, a power half-bridge self-excited oscillation circuit 32, and a filter loop 33.

Concretely, the power half-bridge self-excited oscillation circuit 32 includes a transformer T1, an upper MOSFET Q7, and a lower MOSFET Q8. And the transformer includes: a primary winding N1 having a dotted terminal coupled with the trigger circuit 31 where the input terminal of the power half-bridge self-excited oscillation circuit 32 is connected, and the other terminal of the primary winding N1 is grounded; a first secondary winding N2 having a dotted terminal coupled with a control terminal of the upper MOSFET Q7, and the other terminal of the first secondary winding N2 is coupled with an output terminal of the upper MOSFET Q7 where the output terminal of the power half-bridge self-excited oscillation circuit is connected; and a second secondary winding N3 having a dotted terminal grounded, and the other terminal of the second secondary winding N3 coupled with an control terminal of the lower MOSFET Q8. Furthermore, an input terminal of the upper MOSFET Q7 is coupled with supply voltage, and an input terminal of the lower MOSFET Q8 is coupled with the output terminal of the upper MOSFET Q7 and the output terminal of the lower MOSFET Q8 is grounded.

As an embedment of the present invention, the upper MOSFET Q7 and the lower MOSFET Q8 are N-type MOSFET.

The filter loop 33 includes a capacitor C5, a capacitor C6, an inductor L4, and an inductor L5.

Concretely, one terminal of the capacitor C5 is the input terminal of the filter loop 33, and the other terminal of the capacitor C5 is coupled with one terminal of the inductor L4, the other terminal of the inductor L4 is coupled with one terminal of the capacitor C6, and the other terminal of the capacitor C6 is grounded. One terminal of the inductor L5 is coupled with a common terminal of the inductor L4 and the capacitor C6, and the other terminal of the inductor L5 is the output terminal of the filter loop 33.

In the present embodiment, when the trigger circuit 31 outputs an original single pulse signal, the transformer T1 is excited, and then the primary winding N1 of the transformer T1 discharges quickly. As a result, the first secondary winding N2 and the second secondary winding N3 of the transformer T1 respectively induce two sine wave induced voltages with the same amplitude and the opposite phase, which causes the upper MOSFET Q7 having the same phase with that of the primary winding N1 turn on, and the lower MOSFET Q8 turn off and, in turn, voltage increment dv/dt between the drain electrode and the source electrode of the upper MOSFET Q7 is decreased rapidly while current increment di/dt is increased rapidly, finally the variable current flows through the inductor L4 and is grounded via the capacitor C6, till then, a "pull-up" movement is accomplished.

After a half period, the upper MOSFET Q7 is turned off, and its phase is negative, and the lower MOSFET Q8 is turned on. As a result, the current flows through the inductor L4 and the capacitor C6, and then the lower MOSFET Q8 discharges to the ground loop rapidly, till then, a "sink" movement is accomplished.

In the embodiments of the present invention, when the upper MOSFET Q7 is turned on, and the lower MOSFET Q8 is turned off; while the lower MOSFET Q8 is turned on, and the upper MOSFET Q7 is turned off. Repeating the period mentioned above, square wave signals are output at the midpoint between the upper MOSFET Q7 and the lower MOSFET Q8, whose amplitude is equal to $V_{cc}$-2I*$R_{on}$, wherein $V_{cc}$ is the power supply, I is the variable current, and Ron is the on-resistance. And then, the square wave signals are converted into high-voltage sine wave signals after filtered by the frequency selection circuit formed by the capacitor C5, the inductor L4 and the capacitor C6 and then boosted with Q times. Concretely, the capacitor C5 is a blocking capacitor, the inductor L4 and the capacitor C6 constitute a series resonant circuit. Sequentially, when the HID lamp tube is lighted, its impedance is decreased greatly, such that the inductor L5 and the capacitors C6 constitute a parallel resonant circuit with load consumed. For the HID lamp, such a convention is equivalent to convert a low-impedance voltage source into a high-impedance current source, thereby achieving the current limitation and a constant power supply.

The filter loop 33 also can be acted as a starting unit for quickly starting the HID lamp. As the HID lamp is a capacitive load, static capacitance between the two electrodes is only several Picofarad (Pf), thus the HID lamp's impedance is very large before it's lighted. When two terminals of the load receive the power strong signals, and the lamp is not started, high induced voltage will be generated at the two electrode terminals of the HID lamp due to self-induction. Such a high induced voltage is enough to light the lamp, such that no special trigger starting circuit is needed. Once the HID lamp is lighted, its impedance will be decreased to a very low value. And under normal operation status, the voltage between the two electrode terminals of the HID lamp will be decreased to the operating voltage about between 90-180V.

Figure 4:
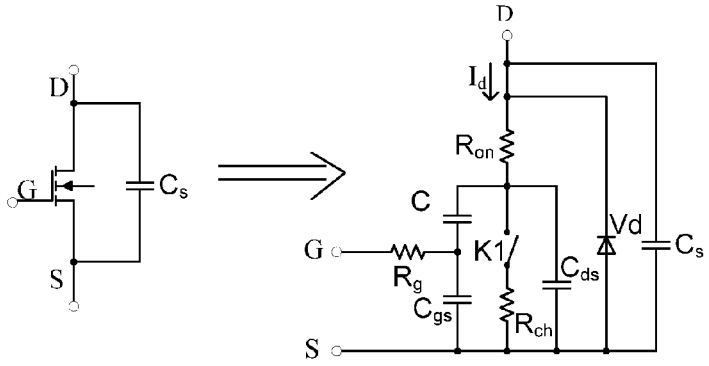
FIG. 4 is a schematic diagram of a power MOSFET and an equivalent circuit thereof provided by an embodiment of the present invention.

FIG. 4 is a schematic diagram of a power MOSFET and an equivalent circuit thereof provided by an embodiment of the present invention. For convenience to explain, only relevant parts are illustrated.

In the embodiments of the present invention, miller capacitors are utilized to act as a subsequent energizing element after the power MOSFET is triggered and turned on by the original pulse excitation, which form and maintain the oscillation frequency.

Concretely, $R_g$ is a gate electrode equivalent resistance of the power MOSFET, whose resistance can reach $10^{13}\Omega$ (considered to be infinite) in the static condition. But once electric field is generated and on-threshold voltage of the gate electrode G of the power MOSFET is achieved, its resistance will be decreased to a very low value. $R_{on}$ is an on-resistor, and $R_{ch}$ is a channel resistor, which can be considered as zero when they are turned on and considered as infinity (namely a gate switch) when they are turned off. $C_{gs}$ is an angle capacitor between the gate electrode G and the source electrode S of the power MOSFET, $C_{dg}$ is an angle capacitor (namely the miller capacitor) between the drain electrode D and the gate electrode G, $C_{ds}$ is an angle capacitor between the drain electrode D and the source electrode S which is so-called the output capacitor, $C_s$ is a decoupling capacitor of the two electrodes of the power supply to provide access for the communication, and $V_d$ is a body diode of the power MOSFET. It should be notice that, connection relationship among the elements of the power MOSFET mentioned above pertaining to common sense is not repeated herein.

In the embodiments of the invention, referring to FIG. 3, when the upper MOSFET Q7 and the lower MOSFET Q8 of the power half-bridge self-excited oscillation circuit 32 are turned on by the single pulse original excitation, with that, voltage V on the drain electrode D is decreased with a speed of dv/dt; at the same time, current i is increased rapidly with a speed of di/dt. A relationship between the variable current and the voltage gradient is: i=Cdv/dt. di/dt is an increment of an avalanche current between the drain electrode and the source electrode of the MOSFET, versus time. This increasing current charges the angle capacitor $C_{gs}$ via the miller capacitor $C_{dg}$ in the interior of the power MOSFET, moreover since it has the same phase with that of the original single pulse, thus the angle capacitor $C_{gs}$ is energized, and oscillation between the excitation coil secondary circuit and eigenfrequency of the angle capacitor $C_{gs}$ is maintained, furthermore, the drain electrode and the source electrode of the MOSFET are turned on. Because the phases of the input circuits of the upper MOSFET Q7 and the lower MOSFET Q8 are opposite, in the first half period, the phase of the gate electrode G of the lower MOSFET Q8 is negative, and the lower MOSFET Q 8 is under off-state; in the second half period, the phase of the gate electrode G of the upper MOSFET Q7 is negative, and the upper MOSFET Q7 is under off-state, while the phase of the lower MOSFET Q8 turns to be positive, as a result the drain electrode D and the source electrode S of the lower MOSFET Q8 are turned on, till then, a "pull-up" and "sink" process is accomplished, such that power is output, and maintained circularly.

As embodiments of the present invention, the operating frequency of the HID electronic ballast circuit is depended by the first secondary winding N2 of the transformer T1, the input junction capacitance $C_{iss}$ and a compensation capacitance $C_s$ of the upper MOSFET Q7, or the second secondary winding N3 of the transformer T1, and an input junction capacitance $C_{iss}$ and a compensation capacitance $C_s$ of the lower MOSFET Q8.

Due to both of the upper MOSFET Q7 and the lower MOSFET Q8 is positive trigger with T/2 time, and their distributed capacitance C* is very small, thus their operating frequency is approximately:

$$f = \frac{1}{2} * \frac{1}{2\pi\sqrt{L_{N2}(C_{iss} + C_s)}}.$$

Thereinto, given the secondary winding of the transformer T1 is $L_{N2}/L_{N3}$=40 μH, a transistor with type of FQPF10N30C is acted as the MOSFET, and the junction capacitance looked by a Component Handbook is $C_{iss}$=2200Pf; and the frequency tuning capacitance (namely the compensation capacitance) is $C_s$=220Pf. With these data, the operating frequency calculated by the relationship above is that, f=268 KHz, which is very closed to the experimental result with f=261 KHz.

Furthermore, given the secondary winding of the transformer T1 is $L_{N2}/L_{N3}$=12 μH, the FQPF10N30C transistor is still applied, and $C_{iss}+C_s$=2400Pf. With these data, the operating frequency calculated by the relationship above is that, f=469 KHz, which is very closed to the experimental result with f=452 KHz.

Since the resonant frequency of the resonant circuit formed by inductors and capacitors connected in series or in parallel is that $$f = \frac{1}{2\pi\sqrt{LC}},$$

and the N-type MOSFET of the present invention is positive trigger, either the upper or lower MOSFET will be turned on once in one period, and twice when overlaying, thus the oscillation frequency is that $$f = \frac{1}{2} * \frac{1}{2\pi\sqrt{L_{N2}(C_{iss} + C_s)}}.$$

In other words, when the operating frequency is the same, and if the inductance L is constant, the capacitance C will be smaller than that of the convention circuit fourfold, which decreases the conversion loss when the MOSFET turns on.

The present invention deduces such a relationship $$f = \frac{1}{2} * \frac{1}{2\pi\sqrt{L_{N2}(C_{iss} + C_s)}}$$

with principle of generating oscillation frequency by energized by the Miller capacitor, and utilizes the ordinary power MOSFET, thereby improving the operating frequency to between 650 KHz to 750 KHz which is beyond the range of "acoustic resonance", thus the problems of "acoustic resonance" and stroboscopic effect are solved. Meanwhile, the electric power reaches to above 250 W, and the MOSFET still maintains its low junction temperature, which improves stability of the circuit.

Figure 5:
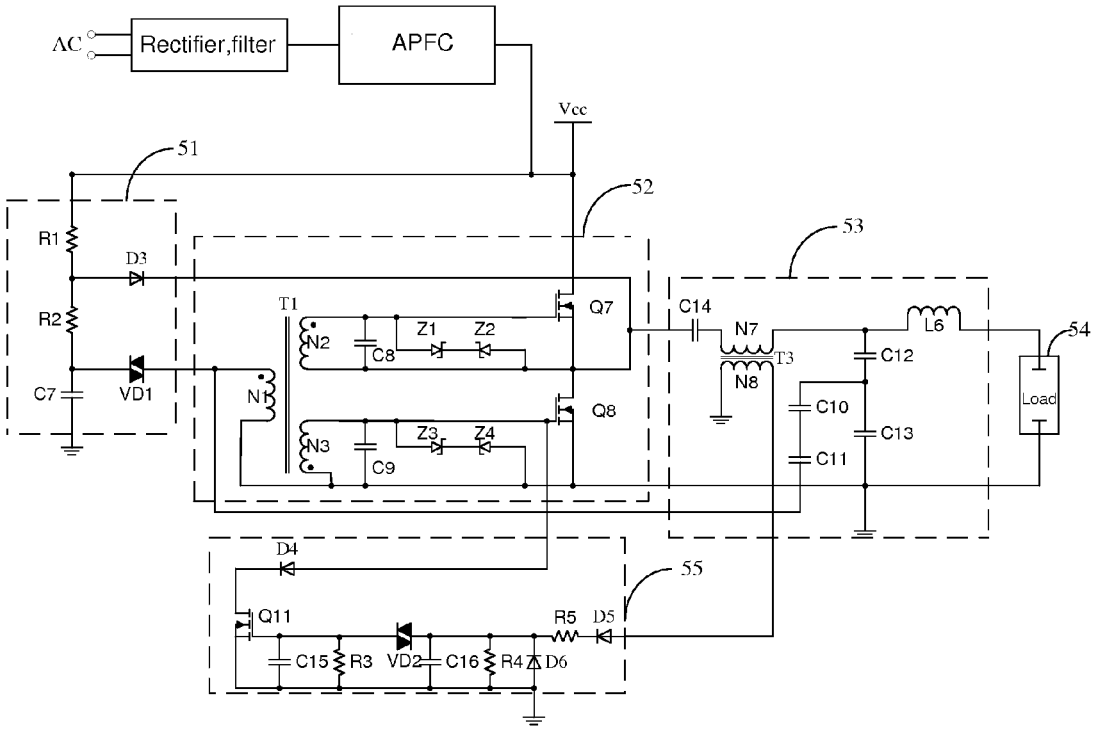
FIG. 5 shows a topology circuit of an HID electronic ballast circuit according to an embodiment of the present invention.

FIG. 5 shows topology circuit of an HID electronic ballast circuit according to an embodiment of the present invention. For convenience to explain, only relevant parts are illustrated.

As shown in the HID electronic ballast, the trigger circuit 51 includes resistors R1, R2, a capacitor C7, a diode D3 and a bidirectional trigger diode VD1.

Concretely, one terminal of the resistor R1 is connected with the power supply $V_{cc}$, the other terminal of the resistor R1 is connected with the anode of the diode D3, and the cathode of the diode D3 is connected with the input terminal of the filter loop 53. One terminal of the resistor R2 is coupled with the anode of the diode D3, and the other terminal of the resistor R2 is grounded via the capacitor C7. A connection terminal of the resistor R2 and the capacitor C7 is coupled with one terminal of the bidirectional trigger diode VD1, and the other terminal of the bidirectional trigger diode VD1 is the output terminal of the trigger circuit 51.

The power half-bridge self-excited oscillation circuit 52 includes the transformer T1, capacitors C8 and C9, Zener diodes Z1, Z2, Z3 and Z4, the upper MOSFET Q7 and the lower MOSFET Q8.

Specifically, the primary winding N1 of the transformer T1 has a dotted terminal coupled with the trigger circuit 51 where the input terminal of the power half-bridge self-excited oscillation circuit is connected. And the other terminal of the primary winding N1 is grounded. The first secondary winding N2 of the transformer T1 is connected in parallel with the capacitor C8. The cathodes of the Zener diodes Z1 and Z2 coupled in series are connected in parallel with the capacitor C8, the anode of the Zener diode Z1 is coupled with the dotted terminal of the first secondary winding N2 and the control terminal of the upper MOSFET Q7, and the anode of the Zener diode Z2 is coupled with the other terminal of the first secondary winding N2 and the output terminal of the upper MOSFET Q7. The input terminal of the upper MOSFET Q7 is coupled with the supply voltage, and the output terminal of the upper MOSFET Q7 is the output terminal of the power half-bridge self-excited oscillation circuit 52. The second secondary winding N3 of the transformer T1 is connected in parallel with the capacitor C9, and the cathodes of the Zener diodes Z3, Z4 coupled in series are connected in parallel with the capacitor C9. The anode of the Zener diode Z3 is coupled with the other terminal of the second secondary winding N3 and the control terminal of the lower MOSFET Q8, and the anode of the Zener diode Z4 is coupled with the dotted terminal of the second secondary winding N3 and the output terminal of the lower MOSFET Q8, and then grounded. The input terminal of the lower MOSFET Q8 is coupled with the output terminal of the upper MOSFET Q7, and the other terminal of the second secondary winding N3 is the abnormal control terminal of the power half-bridge self-excited oscillation circuit 52.

As an embodiment of the present invention, the upper MOSFET Q7 and the lower MOSFET Q8 are N-type MOSFET, and the supply voltage is applied with 400V DC voltage.

Specifically, the filter loop 53 includes a transformer T3, capacitors C10, C11, C12 and C13, and an inductor L6. One terminal of the capacitor C14 is coupled with the output terminal of the power half-bridge self-excited oscillation circuit 52 where the input terminal of the filter loop is connected, the other terminal of the capacitor C14 is coupled with one terminal of a primary winding N7 of the transformer T3, the other terminal of the primary winding N7 is coupled with one terminal of the inductor L6 and one terminal of the capacitor C12, the other terminal of the inductor L6 is the output terminal of the filter loop 53 which is connected with the load—the HID lamp tube. The other terminal of the capacitor C12 is grounded via the capacitor C13. A connection terminal of the capacitors C12 and C13 is coupled with one terminal of the capacitor C10, and the other terminal of the capacitor C10 is coupled with the output terminal of the trigger circuit via the capacitor C11. One terminal of a secondary winding N8 of the transformer T3 is an inducting electrical source terminal of the filter loop 53, and the other terminal of the secondary winding N8 is grounded.

As an embodiment of the present invention, the HID electronic ballast circuit further includes an abnormal protection circuit 55. The abnormal protection circuit 55 has an input terminal coupled with the inducting electrical source terminal of the filter loop 53, and a control terminal coupled with the abnormal control terminal of the power half-bridge self-excited oscillation circuit 52, thereby enforcing to break the power half-bridge self-excited oscillation circuit 52 when an anomaly is generated, so as to protect the HID electronic ballast circuit.

Concretely, the abnormal protection circuit comprises capacitors C15, C16, resistors R3, R4, R5, diodes D4, D5, a clamping diode D6, a switching transistor Q11 and a bidirectional trigger diode VD2.

Specifically, the anode of the diode D4 is the control terminal of the abnormal protection circuit 55, the cathode of the diode D4 is coupled with an input terminal of the switching transistor Q11. The output terminal of the switching transistor Q11 is grounded, the control terminal of the switching transistor Q11 is grounded via the capacitor C15. The resistor R3 is connected in parallel with the capacitor C15, one terminal of the bidirectional trigger diode VD2 is coupled with the control terminal of the switching transistor Q11, and the other terminal of the bidirectional trigger diode VD2 is grounded via the capacitor C16. The resistor R4 is connected in parallel with the capacitor C16. The other terminal of the bidirectional trigger diode VD2 is further connected with one terminal of the resistor R5, and the other terminal of the resistor R5 is connected with the cathode of the diode D5, and the anode of the diode D5 is the input terminal of the abnormal protection circuit 55. The clamping diode D6 is connected in parallel with the resistor R4, the cathode of the clamping diode D6 is connected to a connection terminal of the bidirectional trigger diode VD2 and the resistor R5, and an anode of the clamping diode D6 is grounded.

In the present embodiment, 220V AC is converted into constant DC voltage of 400V after rectified, filtered and compensated by APFC, and then supplies power for the main circuit and charges the capacitor C7 via the first and second resistors R1, R2 of the trigger circuit 51. When the voltage of the capacitor C7 is increased to the threshold voltage of the bidirectional trigger diode VD1, the bidirectional trigger diode VD1 will avalanche, which causes the original pulse current flow through the transform T1 in pulse, and the primary winding N1 of the transformer T1 discharges rapidly. As a result, two sine wave induced voltages with the same amplitude and the opposite phase are respectively induced by the first secondary winding N2 and the second secondary winding N3 of the transformer T1, which causes the upper MOSFET Q7 having the same phase with that of the primary winding N1 turn on, and the lower MOSFET Q8 turn off and, in turn, voltage increment dv/dt between the drain electrode and the source electrode of the upper MOSFET Q7 is decreased rapidly while current increment di/dt is increased rapidly, finally the current flows through the blocking capacitor C14, the primary winding N7 of the transformer T3, and the capacitors C12, C13, and then is grounded, till then, a "pull-up" movement is accomplished.

After a half period, the upper MOSFET Q7 is turned off, and its phase is negative, and the lower MOSFET Q8 is turned on. As a result, the current flows through the blocking capacitor C14, the primary winding N7 of the transformer T3, and the capacitors C12, C13, and then the turn-on lower MOSFET Q8 discharges to the ground loop rapidly, till then, a "sink" movement is accomplished.

In the embodiments of the present invention, when the upper MOSFET Q7 is turned on, and the lower MOSFET Q8 is turned off; while the lower MOSFET Q8 is turned on, and the upper MOSFET Q7 is turned off.

In the embodiments of the present invention, when the angle capacitance $C_{gs}$ of the MOSFET is large, the charging speed of the upper MOSFET Q7 and the lower MOSFET Q8 can be accelerated by increasing the capacitance C10 and the capacitance C11. Please notice that values of the capacitance of the C10 and C11 are very small.

In the embodiments of the present invention, after the upper MOSFET Q7 and the lower MOSFET Q8 are turned on, due to the voltage of the capacitor C7 in the trigger circuit 51 is discharged via the second resistor R2 and the diode D3, thus the voltage between the two ends of the capacitor C7 is maintained about 200V which is lower than the trigger voltage 240V of the bidirectional trigger diode VD1, therefore a dual trigger is avoided.

Repeating the period mentioned above, square wave signals is output at the midpoint between the upper MOSFET Q7 and the lower MOSFET Q8, whose amplitude is equal to $V_{cc}$-2I*$R_{on}$, wherein $V_{cc}$ is the supply voltage, I is the variable current, and $R_{on}$ is the on-resistance. And then, the square wave signals are converted into high-voltage sine wave signals after flowing through the primary winding N7 of the transformer T3 and filtered by the capacitors C12, C13 and boosted with Q times. At this time, the primary winding N7 of the transformer T3 and the capacitors C12, C13 constitute a series resonant circuit. Sequentially, when the HID lamp tube is lighted, its impedance is decreased greatly, such that the inductor L6 and the capacitors C12, C13 constitute a parallel resonant circuit with load consumed. For the HID lamp, such a convention is equivalent to convert a low-impedance voltage source into a high-impedance current source, thereby achieving the current limitation and a constant power supply, and improving the conversion efficiency.

Specifically, the filter loop 53 also can act as a starting unit for quickly starting the HID lamp. As the HID lamp is a capacitive load, static capacitance between the two electrodes is only several Pf, thus the HID lamp's impedance is very large before it's lighted. When two terminals of the load receive the power strong signals, and the lamp is not started, high induced voltage will be generated at the two electrode terminals of the HID lamp due to self-induction. Such a high induced voltage is enough to light the lamp, such that no special trigger starting circuit is needed. Once the HID lamp is lighted, its impedance will be decreased to a very low value. And under normal operation status, voltage between the two electrode terminals of the HID lamp will be decreased to the operating voltage about between 90-180V. And the inductor L6 could function as current limitation. By configuring the capacitors C10, C11 connected in series, it can help to provide a small voltage positive feedback to the exterior under a condition that the ordinary MOSFET has a big current, and the switching speed is low, so as to improve the switching speed, meanwhile cause the abnormal protection circuit 55 achieve a response speed in microsecond or even in nanosecond and, thereby rapidly starting the protective circuit during the delay of starting the HID lamp, which can prevent the upper MOSFET Q7 and the lower MOSFET Q8 from being damaged.

Figure 6:
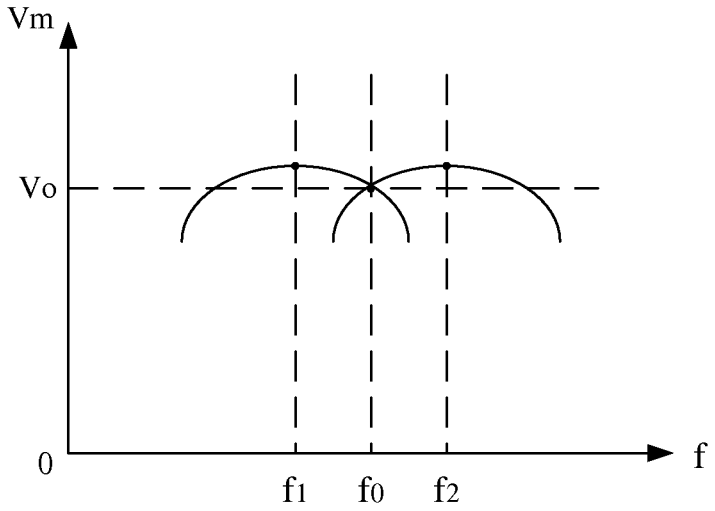
FIG. 6 is a diagram showing frequency extension and quality factor decrease (Q-value decrease) of an HID electronic ballast circuit according to an embodiment of the present invention.

As an embodiment of the present invention, referring to FIGS. 5 and 6, a series resonant circuit could be formed by the primary winding N7 of the transformer T3 and the capacitors C12, C13, whose resonant frequency is lower than the eigenfrequency of the HID electronic ballast circuit. When the HID lamp is lighted, its impedance is decreased greatly, and a parallel resonant circuit with power consumed will be formed by the primary winding N7 of the transformer T3 and the capacitors C12, C13, whose resonant frequency is slightly higher than the eigenfrequency of the HID electronic ballast circuit. Reason for dividing the two frequencies is to extend the frequency bandwidth, so as to make the EMC test pass easily and decrease the Q-value. Concretely, the Q-value of the resonant circuit is that, $$Q = \frac{2\pi fL}{r},$$

where f is the operating frequency, L is the inductance, and r is the copper resistance. If the Q-value is overlarge, the stability and the reliability of the circuit are reduced. Thus when the frequency bandwidth is extended, frequency response with high Q-value of the resonant circuit will be reduced, which may decrease potential risks of the circuit and improve the stability and the reliability of the power output circuit, and decrease the junction temperature of the MOSFET in the half-bridge circuit. Meanwhile, a constant power supplying is achieved by converting the low-impedance voltage source of the series resonant filter circuit into the high-impedance current source of the parallel resonant filter circuit.

When the HID lamp is not started or its starting is delayed, a high-frequency voltage will be induced by two ends of the secondary winding N8 of the transformer T3 in the abnormal protection circuit 55, and then rectified by the diode D5 and filtered by the capacitor C16, and a DC voltage will be formed at two ends of the capacitor C16. Such a DC voltage will be clamped by the clamping diode D6. When the DC voltage is higher than the avalanche threshold of the bidirectional trigger diode VD2, the bidirectional trigger diode VD2 will be turned on which causes the switching transistor Q11 turn on in succession, such that a current is flowed through the control terminal of the lower MOSFET Q8 grounded via the diode D4 and the switching transistor Q11, which forces the lower MOSFET Q8 turn off, as a result the upper MOSFET Q8 and the lower MOSFET Q7 are avoided to be damaged. Such an abnormal protection circuit 55 has a fast response speed, and can be maintained for a suitable time after the anomaly disappears so as to ensure a restart for a normal operation of the circuit.

Luminous flux test is respectively carried out on the conventional HID electronic ballast circuit and the one according to the present invention, with the same HID lamp, and the luminous efficiency tested by the HID electronic ballast circuit according to embodiments of the present invention reaches to 99.9 μm/w, which is higher than that of the conventional one by 6.21 m/w.

In the embodiments of the present invention, the oscillation signals with a frequency range beyond "acoustics resonance" are generated by utilizing self-feedback of the inherent phase relationship of the power MOSFET, which efficiently prevents the stroboscopic effect and improves the luminous efficiency, and keeps the power MOSFET in a low-temperature and stable status and with high power. Furthermore, impedance matching for the oscillation signals is performed by the filter loop, thereby extending the frequency bandwidth and reducing the Q-value, and keeping the constant power supply at the same time, which makes the EMC test pass easily and improves the stability and reliability of the power output circuit. Additionally, the filter loop can replace a drive circuit to trigger the HID lamp, which simplifies the circuit and reduces the manufacturing cost.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A high intensity discharge electronic ballast circuit, comprising:

a trigger circuit, a power half-bridge self-excited oscillation circuit having an input terminal coupled with an output terminal of the trigger circuit, arranged to enable self-excited oscillation by energizing an angle capacitor ($C_{gs}$) with a Miller capacitor ($C_{dg}$) of a power MOSFET when an original single pulse output by the trigger circuit is excited, and then output self-excited oscillation signals, a filter loop having an input terminal coupled with an output terminal of the power half-bridge self-excited oscillation circuit and an output terminal connected with a load HID lamp tube, arranged to match impedance for the self-excited oscillation signals, thereby converting a low-impedance voltage source to a high-impedance constant current source; and an abnormal protection circuit which has an input terminal coupled with an inducting electrical source terminal of the filter loop, and a control terminal coupled with an abnormal control terminal of the power half-bridge self-excited oscillation circuit, thereby enforcing to break the power half-bridge self-excited oscillation circuit when an anomaly is generated, so as to protect the high intensity discharge electronic ballast circuit.

2. The high intensity discharge electronic ballast circuit according to claim 1, wherein the power half-bridge self-excited oscillation circuit comprises a transformer (T1), an upper MOSFET (Q7), and a lower MOSFET (Q8), and the transformer (T1) comprises:

a primary winding (N1) having a dotted terminal coupled with the trigger circuit where the input terminal of the power half-bridge self-excited oscillation circuit is connected, and the other terminal of the primary winding (N1) being grounded;

a first secondary winding (N2) having a dotted terminal coupled with a control terminal of the upper MOSFET (Q7), and the other terminal of the first secondary winding (N2) coupled with an output terminal of the upper MOSFET (Q7) where the output terminal of the power half-bridge self-excited oscillation circuit is connected; and a second secondary winding (N3) having a dotted terminal grounded, and the other terminal of the second secondary winding (N3) coupled with an control terminal of the lower MOSFET (Q8);

wherein an input terminal of the upper MOSFET (Q7) is coupled with supply voltage, and an input terminal of the lower MOSFET (Q8) is coupled with the output terminal of the upper MOSFET (Q7) and the output terminal of the lower MOSFET (Q8) is grounded.

3. The high intensity discharge electronic ballast circuit according to claim 2, wherein the upper MOSFET (Q7) and the lower MOSFET (Q8) are N-type MOSFET.

4. The high intensity discharge electronic ballast circuit according to claim 2, wherein the power half-bridge self-excited oscillation circuit further comprises a capacitor (C8), a capacitor (C9), a Zener diode (Z1), a Zener diode (Z2), a Zener diode (Z3), and a Zener diode (Z4), wherein the first secondary winding (N2) of the transformer (T1) is connected in parallel with the capacitor (C8), cathodes of the Zener diodes (Z1) and (Z2) connected in series are connected in parallel with the capacitor (C8), an anode of the Zener diode (Z1) is coupled with the dotted terminal of the first secondary winding (N2), and an anode of the Zener diode (Z2) is coupled with the other terminal of the first secondary winding (N2);

the second secondary winding (N3) of the transformer (T2) is connected in parallel with the capacitor (C9), cathodes of the Zener diodes (Z3) and (Z4) connected in series are connected in parallel with the capacitor (C9), an anode of the Zener diode (Z3) is coupled with the other terminal of the second secondary winding (N3), and an anode of the Zener diode (Z4) is grounded.

5. The high intensity discharge electronic ballast circuit according to claim 1, wherein the filter loop comprises a capacitor (C5), a capacitor (C6), an inductor (L4), and an inductor (L5), wherein one terminal of the capacitor (C5) is the input terminal of the filter loop, and the other terminal of the capacitor (C5) is coupled with one terminal of the inductor (L4), the other terminal of the inductor (L4) is coupled with one terminal of the capacitor (C6), and the other terminal of the capacitor (C6) is grounded; one terminal of the inductor (L5) is coupled with a common terminal of the inductor (L4) and the capacitor (C6), and the other terminal of the inductor (L5) is the output terminal of the filter loop.

6. The high intensity discharge electronic ballast circuit according to claim 1, wherein filter loop comprises a transformer (T3), a capacitor (C10), a capacitor (C11), a capacitor (C12), a capacitor (C13), and an inductor (L6), wherein one terminal of the capacitor (C14) is coupled with the output terminal of the power half-bridge self-excited oscillation circuit where the input terminal of the filter loop is connected, the other terminal of the capacitor (C14) is coupled with one terminal of a primary winding (N7) of the transformer (T3), the other terminal of the primary winding (N7) is coupled with one terminal of the inductor (L6) and one terminal of the capacitor (C12), the other terminal of the inductor (L6) is the output terminal of the filter loop, and the other terminal of the capacitor (C12) is grounded via the capacitor (C13); a connection terminal of the capacitors (C12) and (C13) is coupled with one terminal of the capacitor (C10), and the other terminal of the capacitor (C10) is coupled with the output terminal of the trigger circuit via the capacitor (C11); one terminal of the secondary winding (N8) of the transformer (T3) is an inducting electrical source terminal of the filter loop, and the other terminal of the secondary winding (N8) is grounded.

7. The high intensity discharge electronic ballast circuit according to claim 1, wherein the abnormal protection circuit comprises a capacitor (C15), a capacitor (C16), a resistor (R3), a resistor (R4), a resistor (R5), a diode (D4), a diode (D5), a clamping diode (D6), a switching transistor (Q11) and a bidirectional trigger diode (VD2), wherein an anode of the diode (D4) is the control terminal of the abnormal protection circuit, an cathode of the diode (D4) is coupled with an input terminal of the switching transistor (Q11), an output terminal of the switching transistor (Q11) is grounded, a control terminal of the switching transistor (Q11) is grounded via the capacitor (C15); the resistor (R3) is connected in parallel with the capacitor (C15); one terminal of the bidirectional trigger diode (VD2) is coupled with the control terminal of the switching transistor (Q11), and the other terminal of the bidirectional trigger diode (VD2) is grounded via the capacitor (C16); the resistor (R4) is connected in parallel with the capacitor (C16); the other terminal of the bidirectional trigger diode (VD2) is further connected with one terminal of the resistor (R5), and the other terminal of the resistor (R5) is connected with an cathode of the diode (D5), and an anode of the diode (D5) is the input terminal of the abnormal protection circuit; the clamping diode (D6) is connected in parallel with the resistor (R4), an cathode of the clamping diode (D6) is connected to a connection terminal of the bidirectional trigger diode (VD2) and the resistor (R5), and an anode of the clamping diode (D6) is grounded.

8. An electronic ballast, comprising a high intensity discharge electronic ballast circuit which comprises:

a trigger circuit, a power half-bridge self-excited oscillation circuit having an input terminal coupled with an output terminal of the trigger circuit, arranged to enable self-excited oscillation by energizing an angle capacitor ($C_{gs}$) with a Miller capacitor ($C_{dg}$) of a power MOSFET when an original single pulse output by the trigger circuit is excited, and then output self-excited oscillation signals, a filter loop having an input terminal coupled with an output terminal of the power half-bridge self-excited oscillation circuit and an output terminal connected with a load HID lamp tube, arranged to match impedance for the self-excited oscillation signals, thereby converting a low-impedance voltage source to a high-impedance constant current source, and an abnormal protection circuit which has an input terminal coupled with an inducting electrical source terminal of the filter loop, and a control terminal coupled with an abnormal control terminal of the power half-bridge self-excited oscillation circuit, thereby enforcing to break the power half-bridge self-excited oscillation circuit when an anomaly is generated, so as to protect the high intensity discharge electronic ballast circuit.

9. The electronic ballast according to claim 8, wherein the power half-bridge self-excited oscillation circuit comprises a transformer (T1), an upper MOSFET (Q7), and a lower MOSFET (Q8), and the transformer (T1) comprises:

a primary winding (N1) having a dotted terminal coupled with the trigger circuit where the input terminal of the power half-bridge self-excited oscillation circuit is connected, and the other terminal of the primary winding (N1) being grounded;

a first secondary winding (N2) having a dotted terminal coupled with a control terminal of the upper MOSFET (Q7), and the other terminal of the first secondary winding (N2) coupled with an output terminal of the upper MOSFET (Q7) where the output terminal of the power half-bridge self-excited oscillation circuit is connected; and a second secondary winding (N3) having a dotted terminal grounded, and the other terminal of the second secondary winding (N3) coupled with an control terminal of the lower MOSFET (Q8);

wherein an input terminal of the upper MOSFET (Q7) is coupled with supply voltage, and an input terminal of the lower MOSFET (Q8) is coupled with the output terminal of the upper MOSFET (Q7) and the output terminal of the lower MOSFET (Q8) is grounded.

10. The electronic ballast according to claim 9, wherein the power half-bridge self-excited oscillation circuit further comprises a capacitor (C8), a capacitor (C9), a Zener diode (Z1), a Zener diode (Z2), a Zener diode (Z3), and a Zener diode (Z4), wherein the first secondary winding (N2) of the transformer (T1) is connected in parallel with the capacitor (C8), cathodes of the Zener diodes (Z1) and (Z2) connected in series are connected in parallel with the capacitor (C8), an anode of the Zener diode (Z1) is coupled with the dotted terminal of the first secondary winding (N2), and an anode of the Zener diode (Z2) is coupled with the other terminal of the first secondary winding (N2);

the second secondary winding (N3) of the transformer (T2) is connected in parallel with the capacitor (C9), cathodes of the Zener diodes (Z3) and (Z4) connected in series are connected in parallel with the capacitor (C9), an anode of the Zener diode (Z3) is coupled with the other terminal of the second secondary winding (N3), and an anode of the Zener diode (Z4) is grounded.

11. The electronic ballast according to claim 8, wherein the filter loop comprises a capacitor (C5), a capacitor (C6), an inductor (L4), and an inductor (L5), wherein one terminal of the capacitor (C5) is the input terminal of the filter loop, and the other terminal of the capacitor (C5) is coupled with one terminal of the inductor (L4), the other terminal of the inductor (L4) is coupled with one terminal of the capacitor (C6), and the other terminal of the capacitor (C6) is grounded; one terminal of the inductor (L5) is coupled with a common terminal of the inductor (L4) and the capacitor (C6), and the other terminal of the inductor (L5) is the output terminal of the filter loop.

12. The electronic ballast according to claim 8, wherein filter loop comprises a transformer (T3), a capacitor (C10), a capacitor (C11), a capacitor (C12), a capacitor (C13), and an inductor (L6), wherein one terminal of the capacitor (C14) is coupled with the output terminal of the power half-bridge self-excited oscillation circuit where the input terminal of the filter loop is connected, the other terminal of the capacitor (C14) is coupled with one terminal of a primary winding (N7) of the transformer (T3), the other terminal of the primary winding (N7) is coupled with one terminal of the inductor (L6) and one terminal of the capacitor (C12), the other terminal of the inductor (L6) is the output terminal of the filter loop, and the other terminal of the capacitor (C12) is grounded via the capacitor (C13); a connection terminal of the capacitors (C12) and (C13) is coupled with one terminal of the capacitor (C10), and the other terminal of the capacitor (C10) is coupled with the output terminal of the trigger circuit via the capacitor (C11); one terminal of the secondary winding (N8) of the transformer (T3) is an inducting electrical source terminal of the filter loop, and the other terminal of the secondary winding (N8) is grounded.

13. The electronic ballast according to claim 8, wherein the abnormal protection circuit comprises a capacitor (C15), a capacitor (C16), a resistor (R3), a resistor (R4), a resistor (R5), a diode (D4), a diode (D5), a clamping diode (D6), a switching transistor (Q11) and a bidirectional trigger diode (VD2), wherein an anode of the diode (D4) is the control terminal of the abnormal protection circuit, an cathode of the diode (D4) is coupled with an input terminal of the switching transistor (Q11), an output terminal of the switching transistor (Q11) is grounded, a control terminal of the switching transistor (Q11) is grounded via the capacitor (C15); the resistor (R3) is connected in parallel with the capacitor (C15); one terminal of the bidirectional trigger diode (VD2) is coupled with the control terminal of the switching transistor (Q11), and the other terminal of the bidirectional trigger diode (VD2) is grounded via the capacitor (C16); the resistor (R4) is connected in parallel with the capacitor (C16); the other terminal of the bidirectional trigger diode (VD2) is further connected with one terminal of the resistor (R5), and the other terminal of the resistor (R5) is connected with an cathode of the diode (D5), and an anode of the diode (D5) is the input terminal of the abnormal protection circuit; the clamping diode (D6) is connected in parallel with the resistor (R4), an cathode of the clamping diode (D6) is connected to a connection terminal of the bidirectional trigger diode (VD2) and the resistor (R5), and an anode of the clamping diode (D6) is grounded.

14. A high intensity discharge lamp, comprising an electronic ballast with a high intensity discharge electronic ballast circuit which comprises:

a trigger circuit, a power half-bridge self-excited oscillation circuit having an input terminal coupled with an output terminal of the trigger circuit, arranged to enable self-excited oscillation by energizing an angle capacitor ($C_{gs}$) with a Miller capacitor ($C_{dg}$) of a power MOSFET when an original single pulse output by the trigger circuit is excited, and then output self-excited oscillation signals, a filter loop having an input terminal coupled with an output terminal of the power half-bridge self-excited oscillation circuit and an output terminal connected with a load HID lamp tube, arranged to match impedance for the self-excited oscillation signals, thereby converting a low-impedance voltage source to a high-impedance constant current source, and an abnormal protection circuit which has an input terminal coupled with an inducting electrical source terminal of the filter loop, and a control terminal coupled with an abnormal control terminal of the power half-bridge self-excited oscillation circuit, thereby enforcing to break the power half-bridge self-excited oscillation circuit when an anomaly is generated, so as to protect the high intensity discharge electronic ballast circuit.

15. The high intensity discharge lamp according to claim 14, wherein the power half-bridge self-excited oscillation circuit comprises a transformer (T1), an upper MOSFET (Q7), and a lower MOSFET (Q8), and the transformer (T1) comprises:

a primary winding (N1) having a dotted terminal coupled with the trigger circuit where the input terminal of the power half-bridge self-excited oscillation circuit is connected, and the other terminal of the primary winding (N1) being grounded;

a first secondary winding (N2) having a dotted terminal coupled with a control terminal of the upper MOSFET (Q7), and the other terminal of the first secondary winding (N2) coupled with an output terminal of the upper MOSFET (Q7) where the output terminal of the power half-bridge self-excited oscillation circuit is connected; and a second secondary winding (N3) having a dotted terminal grounded, and the other terminal of the second secondary winding (N3) coupled with an control terminal of the lower MOSFET (Q8);

wherein an input terminal of the upper MOSFET (Q7) is coupled with supply voltage, and an input terminal of the lower MOSFET (Q8) is coupled with the output terminal of the upper MOSFET (Q7) and the output terminal of the lower MOSFET (Q8) is grounded.

16. The high intensity discharge lamp according to claim 15, wherein the power half-bridge self-excited oscillation circuit further comprises a capacitor (C8), a capacitor (C9), a Zener diode (Z1), a Zener diode (Z2), a Zener diode (Z3), and a Zener diode (Z4), wherein the first secondary winding (N2) of the transformer (T1) is connected in parallel with the capacitor (C8), cathodes of the Zener diodes (Z1) and (Z2) connected in series are connected in parallel with the capacitor (C8), an anode of the Zener diode (Z1) is coupled with the dotted terminal of the first secondary winding (N2), and an anode of the Zener diode (Z2) is coupled with the other terminal of the first secondary winding (N2);

the second secondary winding (N3) of the transformer (T2) is connected in parallel with the capacitor (C9), cathodes of the Zener diodes (Z3) and (Z4) connected in series are connected in parallel with the capacitor (C9), an anode of the Zener diode (Z3) is coupled with the other terminal of the second secondary winding (N3), and an anode of the Zener diode (Z4) is grounded.

17. The high intensity discharge lamp according to claim 14, wherein filter loop comprises a transformer (T3), a capacitor (C10), a capacitor (C11), a capacitor (C12), a capacitor (C13), and an inductor (L6), wherein one terminal of the capacitor (C14) is coupled with the output terminal of the power half-bridge self-excited oscillation circuit where the input terminal of the filter loop is connected, the other terminal of the capacitor (C14) is coupled with one terminal of a primary winding (N7) of the transformer (T3), the other terminal of the primary winding (N7) is coupled with one terminal of the inductor (L6) and one terminal of the capacitor (C12), the other terminal of the inductor (L6) is the output terminal of the filter loop, and the other terminal of the capacitor (C12) is grounded via the capacitor (C13); a connection terminal of the capacitors (C12) and (C13) is coupled with one terminal of the capacitor (C10), and the other terminal of the capacitor (C10) is coupled with the output terminal of the trigger circuit via the capacitor (C11); one terminal of the secondary winding (N8) of the transformer (T3) is an inducting electrical source terminal of the filter loop, and the other terminal of the secondary winding (N8) is grounded.

18. The high intensity discharge lamp according to claim 14, wherein the abnormal protection circuit comprises a capacitor (C15), a capacitor (C16), a resistor (R3), a resistor (R4), a resistor (R5), a diode (D4), a diode (D5), a clamping diode (D6), a switching transistor (Q11) and a bidirectional trigger diode (VD2), wherein an anode of the diode (D4) is the control terminal of the abnormal protection circuit, an cathode of the diode (D4) is coupled with an input terminal of the switching transistor (Q11), an output terminal of the switching transistor (Q11) is grounded, a control terminal of the switching transistor (Q11) is grounded via the capacitor (C15); the resistor (R3) is connected in parallel with the capacitor (C15); one terminal of the bidirectional trigger diode (VD2) is coupled with the control terminal of the switching transistor (Q11), and the other terminal of the bidirectional trigger diode (VD2) is grounded via the capacitor (C16); the resistor (R4) is connected in parallel with the capacitor (C16); the other terminal of the bidirectional trigger diode (VD2) is further connected with one terminal of the resistor (R5), and the other terminal of the resistor (R5) is connected with an cathode of the diode (D5), and an anode of the diode (D5) is the input terminal of the abnormal protection circuit; the clamping diode (D6) is connected in parallel with the resistor (R4), an cathode of the clamping diode (D6) is connected to a connection terminal of the bidirectional trigger diode (VD2) and the resistor (R5), and an anode of the clamping diode (D6) is grounded.

* * * * *